US006755097B2

(12) United States Patent
Bangert

(10) Patent No.: US 6,755,097 B2
(45) Date of Patent: Jun. 29, 2004

(54) GRANULAR PARTICLE GRIPPING SURFACE

(76) Inventor: Daniel S. Bangert, 156 Beau Coteau Pkwy., Broussard, LA (US) 70518

( * ) Notice: Subject to any disclaimer, the term of this patent is extended or adjusted under 35 U.S.C. 154(b) by 123 days.

(21) Appl. No.: 10/099,045

(22) Filed: Mar. 14, 2002

(65) Prior Publication Data

US 2002/0121160 A1 Sep. 5, 2002

Related U.S. Application Data

(63) Continuation-in-part of application No. 09/267,174, filed on Mar. 12, 1999, now Pat. No. 6,378,399, which is a continuation-in-part of application No. 08/967,151, filed on Nov. 10, 1997, now abandoned, which is a continuation-in-part of application No. PCT/US97/16443, filed on Sep. 15, 1997.

(51) Int. Cl.[7] ..... B25B 17/00

(52) U.S. Cl. ..... 81/57.5; 81/57.33; 81/57.18; 81/57.15; 294/102.2

(58) Field of Search ..... 81/57.5, 57.15, 81/57.33, 57.7, 57.18, 186, 57.17, 64; 294/102.2; 166/77.51–77.53, 98

(56) References Cited

U.S. PATENT DOCUMENTS

| | | | | |
|---|---|---|---|---|
| 1,371,943 A | | 3/1921 | Sperduti | |
| 2,637,236 A | | 5/1953 | Vergnani et al. | 81/180 |
| 2,714,321 A | | 8/1955 | Tamplin | 81/52 |
| 3,024,128 A | | 3/1962 | Dawson | 117/22 |
| 3,365,762 A | | 1/1968 | Spiri | 24/263 |
| 3,656,522 A | | 4/1972 | Ingimarsson | 145/50 |
| 4,576,067 A | | 3/1986 | Buck | 81/57.15 |
| 4,643,740 A | | 2/1987 | Nicolson | 51/293 |
| 4,778,730 A | | 10/1988 | Zucker | 81/900 |
| 4,823,919 A | * | 4/1989 | Hayatdavoudi | 81/57.5 |
| 4,989,909 A | | 2/1991 | Bouligny, Jr. et al. | 294/119.3 |
| 5,148,726 A | | 9/1992 | Huebschen et al. | 81/119 |
| 5,150,642 A | * | 9/1992 | Moody et al. | 81/57.2 |
| 5,451,084 A | * | 9/1995 | Jansch | 294/1.1 |
| 6,004,362 A | * | 12/1999 | Seals et al. | 51/295 |
| 6,378,399 B1 | * | 4/2002 | Bangert | 81/57.15 |

FOREIGN PATENT DOCUMENTS

| | | | |
|---|---|---|---|
| GB | 2063743 | 6/1981 | 81/900 |

OTHER PUBLICATIONS

Kinzel, Buttner; *Evaluation of Corrosion on CRA–Pipe*; Sep. 9, 1996; Kuala Lumpur, Malaysia.

* cited by examiner

*Primary Examiner*—Lee D. Wilson
(74) *Attorney, Agent, or Firm*—Jones, Walker, Waechter, Poitevent, Carrere & Denegre, LLP

(57) ABSTRACT

An improved die insert for gripping oil field tubular members in tubular handling systems such as power tongs, slips, safety clamps and the like. The die insert has a gripping surface which comprises a backing surface adapted to contact the tubular member. The backing surface may be smooth or it may have a series of teeth formed thereon. The backing surface further has a granulated particle coating applied thereto which forms the gripping surface of the present invention. In a preferred embodiment, the gripping surface will include a refractory metal carbide selected from the group consisting of the carbides of silicon, tungsten, molybdenum, chromium, tantalum, niobium, vanadium, titanium, zirconium, and boron.

33 Claims, 12 Drawing Sheets

SECTION A–A

DETAIL "A"

DETAIL "B"

170
163
166
168
SECTION A–A 160
170
169
A
A
164
162
163
164
165
166
167

GRANULAR PARTICLE GRIPPING SURFACE

This application is a continuation-in-part of and claims priority to U.S. application Ser. No. 09/267,174, filed Mar. 12, 1999, now U.S. Pat. No. 6,378,399 which claims priority to PCT/US97/16443 filed on Sep. 15, 1997, which claims a priority date of Sep. 13, 1996 to U.S. application Ser. No. 08/713,444, filed Sep. 13, 1996, now abandoned.

TECHNICAL FIELD

This invention relates to devices used in the oil and gas well drilling industry to grip tubular members, such as oil well piping and casing, in order to rotate the tubular member, hold the tubular member fixed against rotation, or to hold the tubular member against vertical movement. In particular, this invention relates to gripping devices that can securely grip an oil field tubular member while not leaving damaging gouges or marks on the surface of the tubular member.

BACKGROUND OF INVENTION

There presently exist numerous devices that may be used to grip tubular members while torque is being applied to the tubular member. Such devices include by way of illustration "power tongs," "backups," and "chrome tools" and various other devices for gripping tubular members. Examples of power tongs are disclosed in U.S. Pat. Nos. 4,649,777 and 5,291,808 to David Buck. Typically power tongs will have a set of jaws which are the actual components of the power tongs which grip the tubular member. One example of these jaws is set forth in U.S. Pat. No. 4,576,067 to David Buck. The jaws disclosed in U.S. Pat. No. 4,576,067 include a die member which is the sub-component of the jaw that actually contacts the tubular member. In U.S. Pat. No. 4,576,067, the face of the die that contacts the tubular member has ridges or teeth cut therein. Typically, the teeth are sized such that 5 to 8 teeth per linear inch are formed across the gripping surface of the die. When the jaws close upon the tubular member, these teeth firmly bite into the tubular member and prevent slippage between the tubular member and jaws when large torque loads are applied to the power tongs or the tubular member.

Another class of devices to which the invention pertains grips the tubular in order to hold the tubular against vertical movement. Typically, the tubular is part of a tubing, casing or drill string formed from a long series of tubulars and the drill string is suspended above and/or in the well bore. This class of devices includes conventional slips, elevators and safety clamps. Slips and safety clamps utilize the weight of the tubular and/or drill string, and, in some cases, an external preload, to force the gripping surfaces into contact with the tubular being gripped. By way of example, the gripping member of the slip will have a gripping surface or gripping die on one face and an inclined plane on an opposite face. A slip bowl or similar device having a second and supplementary inclined surface will be positioned around the tubular with sufficient space between the tubular and slip bowl for the gripping member to be partially inserted between the slip bowl and tubular. As described in more detail below, the movement of the gripping member's inclined surface along the slip bowl's inclined surface causes the gripping surface to move toward and engage the tubular. The die or gripping surface of prior art slips is similar to the above described power tong jaw dies in that the gripping surface generally comprises a series of steel teeth which bite into the tubular to grip it.

While the above described methods for gripping pipe has been successful in many applications, there are certain disadvantages. One disadvantage is that after gripping tubular members, the teeth from the die will leave deep indentations or gouges in the surface of the tubular member. These "bite marks" left by the teeth may effect the structural integrity of the tubular member by causing a weak point in the metal which may render the tubular member unsuitable for further use or may lead to premature failure of the tubular at a future date.

A second disadvantage is encountered when using the dies with corrosion resistant alloy (CRA) tubular members. Exotic Stainless Steel with large percentages of Chromium, Nickle, etc., are typical CRA materials used in the oil and gas drilling industry. Oil and gas production frequently occurs in high temperature, corrosive environments. Because the above described die teeth are normally constructed of standard carbon steel, the bite mark made by the die teeth tend to introduce iron onto the surface of the CRA tubular. In such environments, the iron in the bite mark can act as a catalyst, causing a premature, rapid corrosion failure in the CRA tubular.

A further problem is encounter in that many CRA materials such as stainless steel are work hardened materials. This means that the malleability of the material decreases after the material is mechanically stressed. In the case of stainless steel tubulars, the bite marks or indentations caused by the prior art die teeth produce localized "cold working." The points at which the teeth marks have been made are then less malleable than the other sections of the tubular and therefore may create inherent weak points in the tubular's structural integrity. Additionally, prior art steel teeth are formed in a uniform pattern. A series of uniformly sharp teeth bite marks may manifest themselves as a major stress riser with an adverse impact significantly more detrimental than a few individual random marks of similar depth. Thus, an uniform pattern of indentations or bite marks will create more damaging internal stresses in the tubular than a non-uniform pattern of bite marks.

As an alternative to using dies with teeth on CRA tubulars, the industry has employed dies which have smooth aluminum surfaces engaging the tubular. However, because these smooth faced aluminum dies rely purely on a frictional grip of the tubular, these dies must employ significantly greater clamping forces than dies with steel teeth. This greater clamping force in turn increases the risk that the clamping forces themselves will cause damage to the tubular. Furthermore, even with high clamping forces, the aluminum surfaces often do not have a sufficiently high coefficient of friction to prevent slippage between the dies and the tubular at high torque loads or high vertical loads.

To overcome the problem of slippage between the aluminum surfaced dies and a CRA tubular, the industry has developed a method of using a silicon carbide coated fabric or screen in combination with the aluminum surfaced dies. This method consists of placing the silicon carbide screen between the tubular and the dies before the dies close upon the tubular. The dies are then closed on the tubular with the silicon carbide screen positioned in between. The silicon carbide screen thereby allows a substantially higher coefficient of friction to be developed between the dies and the tubular. However, this method also has serious disadvantages. First, the silicon carbide screen must be re-position between the tubular and die surface each time the dies grip and then release a tubular. Thus for example, when a drilling crew is making up or breaking down a long string of drill pipe, several pieces (typically 5 to 6) of the silicon carbide screen must be placed in position for each successive section of pipe being made up or broken out. This repeated operation can be extremely inefficient and costly in terms of lost time. Secondly, this process requires a member of the drilling crew to repeatedly place his hands in a position where they could possible be crushed or amputated. Thirdly, while providing greater resistance to torque than a smooth surfaced aluminum die, there may nevertheless be situations where such high torque forces are being applied to the tubular that the silicon carbide screen method does not prevent slippage between the die and the tubular.

OBJECTS OF THE INVENTION

Therefore it is an object of this invention to provide, in an apparatus for gripping tubular members, a gripping surface which does not leave excessively deep or aligned bite marks, yet has a higher coefficient of friction than found in the present state of the art.

It is another object of this invention to provide a gripping surface that has greater longevity than hereto known in the art.

It is a further object of this invention to provide a high coefficient of friction gripping surface that is safer to employ than hereto known in the art.

An additional objective of this invention is to provide a gripping means which protects tubulars from metallic contamination and resulting corrosion failures.

It is a further object of this invention to provide an improved gripping means with is less damaging to the tubular.

Therefore the present invention provides an improved apparatus for gripping oil field tubular members. The apparatus has a gripping surface which comprises a backing surface adapted to contact an oil field tubular member where the gripping surface is attachable to the apparatus for gripping oil field tubular members. The apparatus further has a granulated particle coating formed on this gripping surface. In a preferred embodiment, the gripping surface will include a refractory metal carbide selected from the group consisting of the carbides of silicon, tungsten, molybdenum, chromium, tantalum, niobium, vanadium, titanium, zirconium, and boron.

The present invention also provides a novel die insert having a die body shaped for insertion into a tubular gripping system. The die has a gripping surface formed on a surface of the die body and this gripping surface includes a series of raised teeth. A granular particle coating is applied to and covers at least the portion of the raised teeth which engage the tubular member.

Finally, the present invention includes a method of gripping oilfield tubular members with a slip system. The method includes providing a slip system which translates the weight of a tubular into a gripping force. The method will position a die insert within the slip system and this die insert will have a gripping surface with a granular particle coating applied thereto. A lifting force will be applied to the tubular in order to place the tubular in a position to be gripped by the gripping surface on the die insert. Then the lifting force will be removed in order to allow the gripping surface of the die insert to engage the tubular.

DETAILED DESCRIPTION OF THE INVENTION

Figure 1:
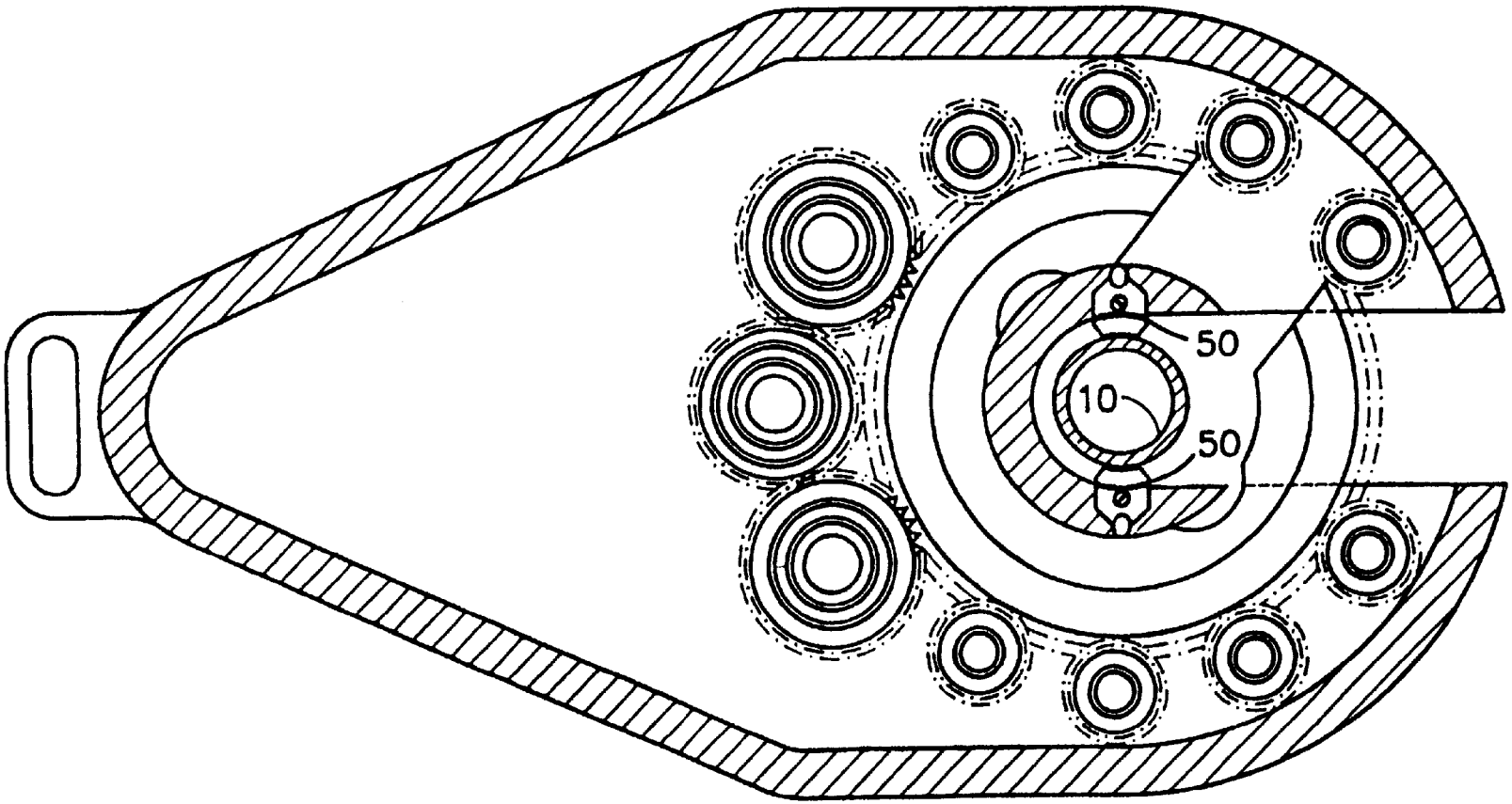
PRIOR ART FIGURE 1
FIG. 1 is a cut-away top view of a conventional power tong illustrating the manner in which the tubular gripping jaws of the power tongs grasp the tubular member.
Figure 2B:
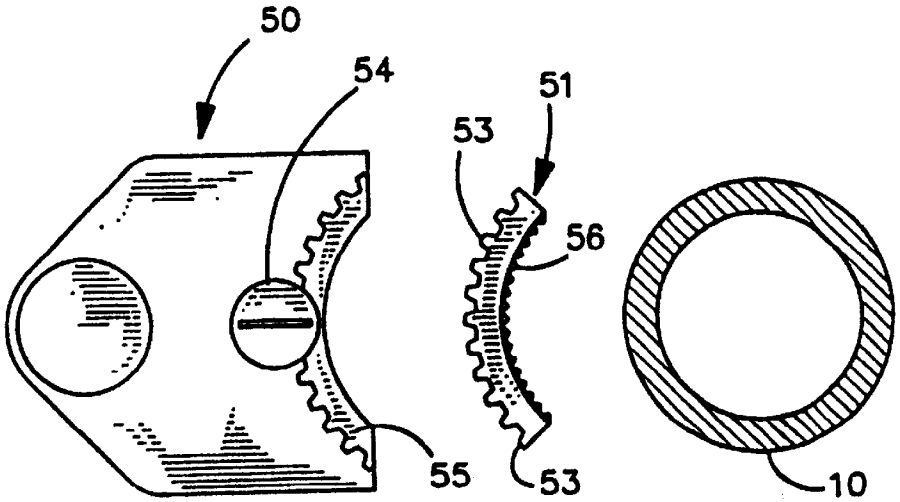
PRIOR ART FIGURE 2b
FIG. 2*b* is a top view of a conventional jaw member showing the die insert separated from the jaw member.
Figure 2A:
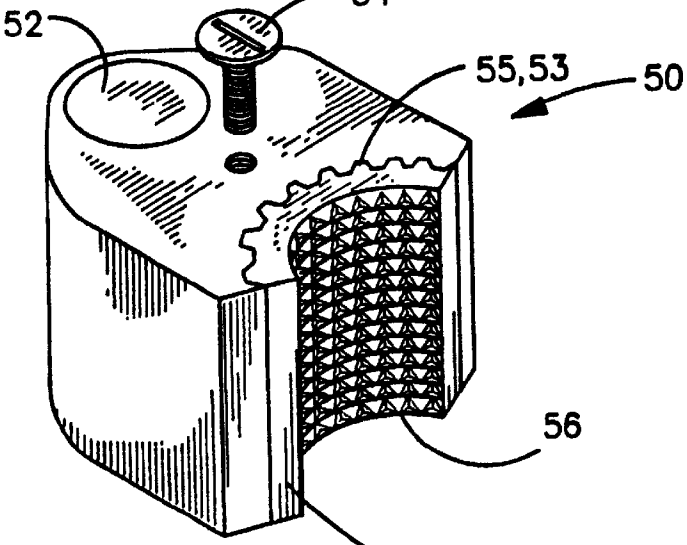
PRIOR ART FIGURE 2a
FIG. 2*a* is a perspective view of a conventional jaw member showing a die insert with conventional tooth pattern gripping surface.

The present invention will be capable of use in various apparatuses for gripping oil field tubular members. The above mention of power tongs, backup power tongs, chrome tools, slips, elevators and safety clamps is intended to be illustrative only. It is believed the present invention will have application in many other types of devices used for gripping oil field tubular members. As discussed herein, oil field tubular member is intended to describe all types of piping, casing, or other tubular members use in the oil and gas industry. These tubulars will typically have a diameter ranging from 1.66 inches to 20 inches, but may in some instances have larger or small diameters. These tubulars will also generally be comprised of a metal having a hardness ranging from approximately 18 HRC for certain carbon steels to approximately 40 HRC for certain hardened chromium steels. One example of such an apparatus for gripping tubulars is the power tongs disclosed in U.S. Pat. No. 5,291,808. FIG. 1 is a top view of the internal parts of this power tong illustrating the location of jaws 50 which close upon and grip oil field tubular member 10. An example of jaw 50 is shown in more detail in FIGS. 2*a* and 2*b*. As explained in detail in U.S. Pat. No. 4,576,067 which is incorporated by reference herein, jaw 50 will include a pin aperture 52 which allows jaw 50 will be connected to the power tong or other apparatus for gripping tubulars. As best seen in FIG. 2*b*, jaw 50 further has a generally concave shaped removably insertable die 51. Die 51 is positioned in jaw 50 by the interlocking of spline 53 and groove 55 and is held in place by retaining screw 54. Concave die 51 is adapted to engage oil field tubular member 10. Die 51 also has a conventional gripping surface 56 formed from a diamond shaped series of gripping teeth. This prior art gripping surface 56 has several of the disadvantages discussed above.

Figure 7:
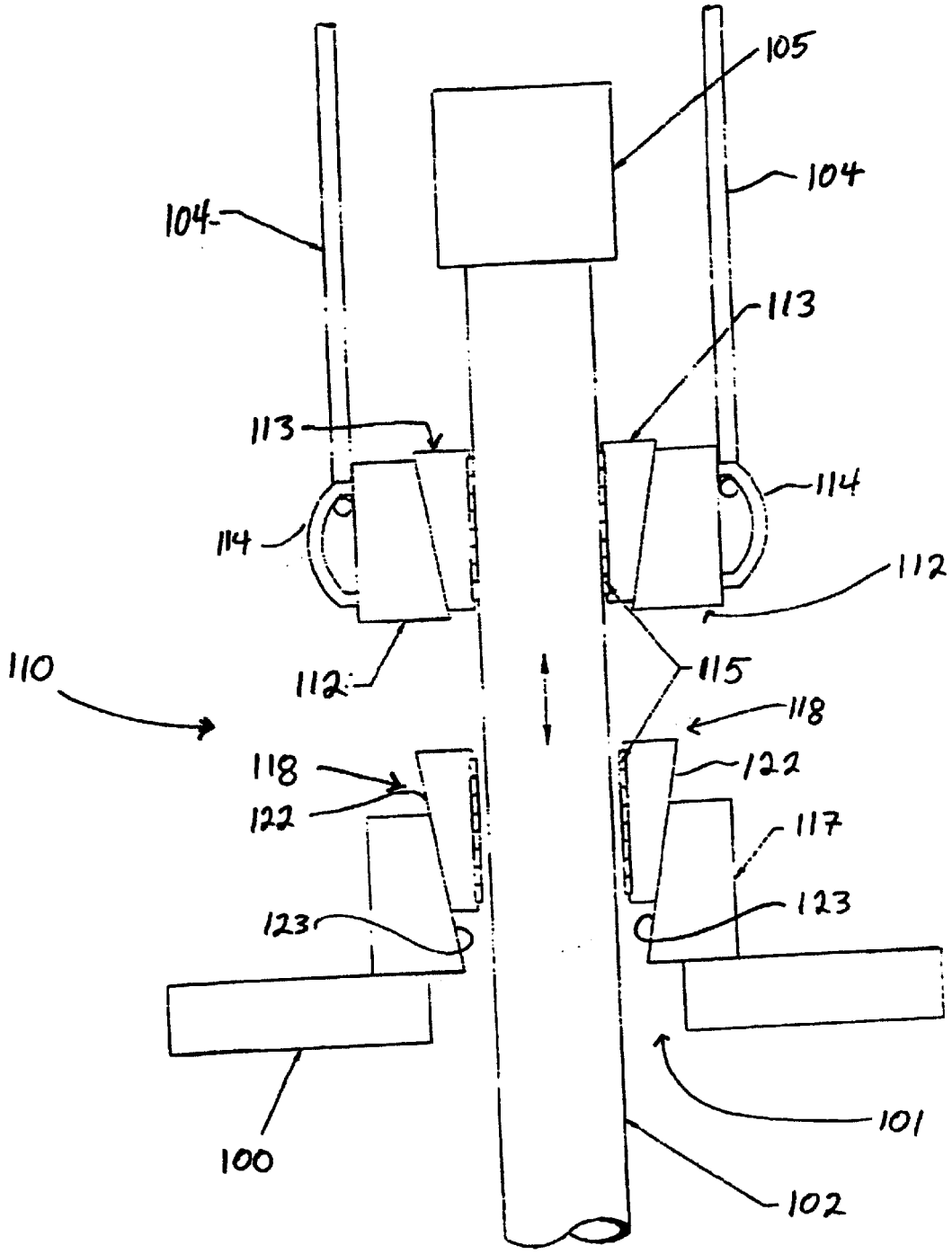
FIG. 7 is a view of a conventional slip system which employs the die inserts of the present invention.

Another apparatus which could employ die inserts of the present invention is a conventional slip system 110 such as shown in FIG. 7. It will be understood that the environment of FIG. 7 is a drilling rig structure, but that for purposes of the present description, the only actual rig structure that need be illustrated as a point of reference is the rig floor 100. Rig floor 100 will have a opening 101 through which a string of tubulars 102 will extend into the well bore below the rig structure. Only the tubular 102 being gripped by the slip system 110 is shown, but it will be understood that a string of tubulars would typically be attached to the illustrated tubular 102. During the normal operations of inserting or removing tubulars from a well bore, is it necessary to grip tubular 102 in order to lift or lower tubular 102 and the attached drill string. One well-known manner of doing so is the slip system 110. Slip system 110 will include a slip bowl 117, slip assemblies 118, elevator bowl 112, elevator slip assemblies 113, and slip die inserts 115. Slip bowl 117 has an annular configuration which encircles the circumference of tubular 102. While not shown in the drawings, slip bowl 117 will often be formed of two semi-circular rings which may be placed around tubular 102 rather than having to position a unitary ring over an end of tubular 102. The two semi-circular rings of slip bowl 117 will be place around tubular 102, the ring ends fastened together, and slip bowl 117 secured to rig floor 100 by any conventional manner. As seen in FIG. 7, there is sufficient space between the interior inclined surfaces 123 of slip bowl 117 such that tubular 102 may freely move there between.

Figure 8C:
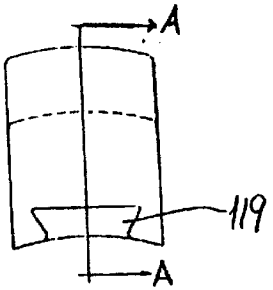
FIG. 8*c* is a top view of the slip assembly seen in FIG. 8*a*.
Figure 8A:
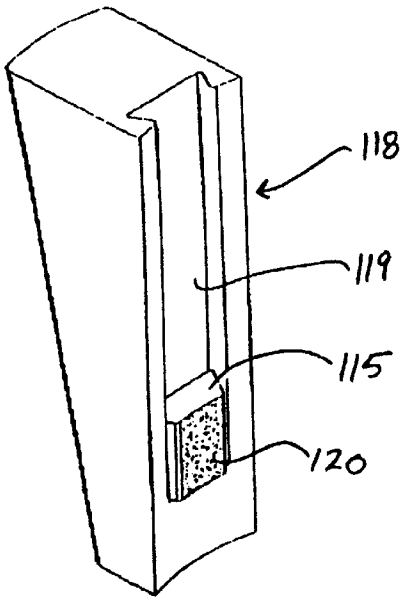
FIG. 8*a* is a perspective view of a conventional slip assembly which employs the die insert of the present invention.
Figure 8D:
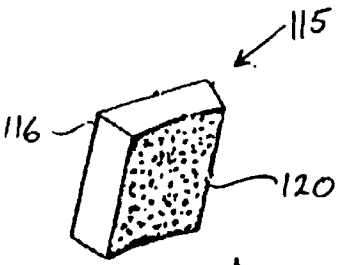
FIG. 8*d* is a perspective view of a die insert having the granular particle coating of the present invention.
Figure 8B:
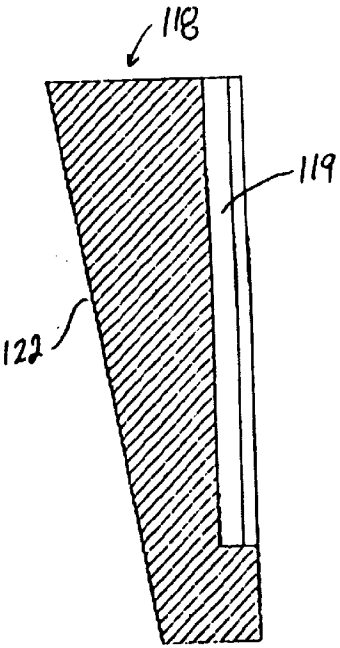
FIG. 8*b* is a side sectional view of the slip assembly seen in FIG. 8*a*.

To arrest the downward movement of tubular 102, slip assemblies 118 will be inserted in the space between slip bowl 117 and tubular 102. While only two slip assemblies 118 are shown, it will be understood that additional slip assemblies could be spaced around the entire perimeter of tubular 102. Slip assemblies 118 are generally wedge shaped with a first inclined surface 122 which is designed to have an angle which is the supplement of the angle of a second inclined surface 123 formed on slip bowl 117. As best seen in FIG. 8*a*, slip assembly 118 will have a die retaining cavity 119 designed to receive a die insert 115. FIGS. 8*c* and 8*d* illustrate the shape of slip die insert 115. FIG. 8*c* shows dove tail retaining cavity 119 which is shaped to receive dove tail backing 116 of slip die insert 115. Slip die insert 115 will also have concave gripping surface 120. The gripping surface 120 seen in FIGS. 8*a* and 8*d* is the granular particle gripping surface of the present invention.

FIGS. 7 and 8*a* illustrate how die inserts 115 will be installed in slip assemblies 118 during use. Once the slip assemblies 118 are in position between slip bowl 117 and tubular 102 as seen in FIG. 7, the inclined surface 122 of slip assemblies 118 may travel downward along bowl inclined surface 123 until slip die inserts 115 contact tubular 102. There are generally two methods of bringing the gripping surfaces of slip die inserts 115 into initial contact with tubular 102. First, the weight of the slips acting on the inclined surfaces may be relied upon to cause the gripping surface of the die inserts to lightly engage or bite into tubular 102. Alternatively, a mechanical system such as hydraulic cylinders maybe used to more firmly wedge the slip die inserts 115 between slip bowl 117 and tubular 102. Both of these methods are well known in the art. After either of these methods provide an initial bite or "sets" the die inserts, allowing the weight of the drill string to pull tubular 102 downward will force slip assemblies 118 downward along bowl inclined surface 123. This will in turn cause slip assemblies 118 and slip die inserts 115 to place a large radial load proportional to the weight of the drill string on tubular 102 and cause the gripping surface of slip die inserts 115 to more securely bite into tubular 102. While it is the weight of the drill string which produces the large radial load on tubular 102, a secure initial bite is critical to the proper functioning of the slips. If the initial bite does not properly set the gripping surface, the weight of the drill string may drag the tubular through the slips some distance before the gripping surfaces of the die inserts are able to firmly grip and arrest the movement of tubular 102. This results in unacceptable scarring and gouging upon the surface of costly CRA tubulars.

Shown also in FIG. 7 is an elevator bowl 112 and elevator slip assemblies 113. Elevator bowl 112 and elevator slip assemblies are virtually identical to slip bowl 117 and slip assemblies 118 excepting that elevator bowl 112 is not adapted to be fixed to the rig floor 100 as is slip bowl 117. Rather, elevator bowl 112 will have brackets 114 or similar devices which allow elevator bowl 112 to be lifted. By way of example, FIG. 7 illustrates lifting bail 104 engaging brackets 114. While not shown in FIG. 7, it will be understood that lifting bail 104 will in turn be attached to draw works or another lifting mechanism being employed on the drilling rig.

The slip assembly 118 and elevator slip assembly 113 will be employed in an alternating grip and release sequence in order to raise or lower tubular 102 and its attached drill string. When it is desired to raise tubular 102, slip bowl 117 will be positioned around tubular 102 and slip assemblies 118 positioned to grip tubular 102. The drilling machinery or the like which is suspending tubular 102 and its attached drill string, will then be relaxed. When tubular 102 is allowed to move downward, slip assembly 118 will firmly grip tubular 102. Elevator bowl 112 will then be positioned around tubular 102 and elevator slip assemblies 113 positioned between tubular 102 and elevator bowl 112. When lifting bail 104 applies a lifting force to elevator bowl 112, elevator slip assemblies 113 will become securely wedged against and grip tubular 102. As the lifting force on elevator bowl 112 continues and raises tubular 102, slip assemblies 118 will slide upward and cease to grip tubular 102. This is referred to as "releasing" slip assemblies 118 and will allow workers to manually remove slip assemblies 118 from slip bowl 117 or, where a hydraulic system is employed, allow the hydraulic cylinder assemblies to raise the slip assemblies 118 high enough along inclined surface 123 so as to prevent interference between slip assemblies 118 and the rising tubular 102. This is the stage of operation which is illustrated in FIG. 7. Typically elevator bowl 112 will lift tubular 102 to a desired height such as the next tubular connecting joint in the drill string being above slip bowl 117. The slip assemblies 118 will again be inserted into slip bowl 117 and be set. Thereafter, the lifting force on elevator bowl 112 will be slowly released so that tubular 102 is allowed to begin downward movement. However, the downward movement of tubular 102 is quickly arrested as slip assemblies 102 once again place a large radial load on tubular 102. At this point, tubular 102 can be broken out and set aside before elevator bowl 112 is then be lowered to a position just above slip assemblies 118 in preparation for another lift sequence. The process is repeated until the desired length of drill string has been raised above the level of the rig floor 100.

Figures 9, 10A, 10B, 10C:
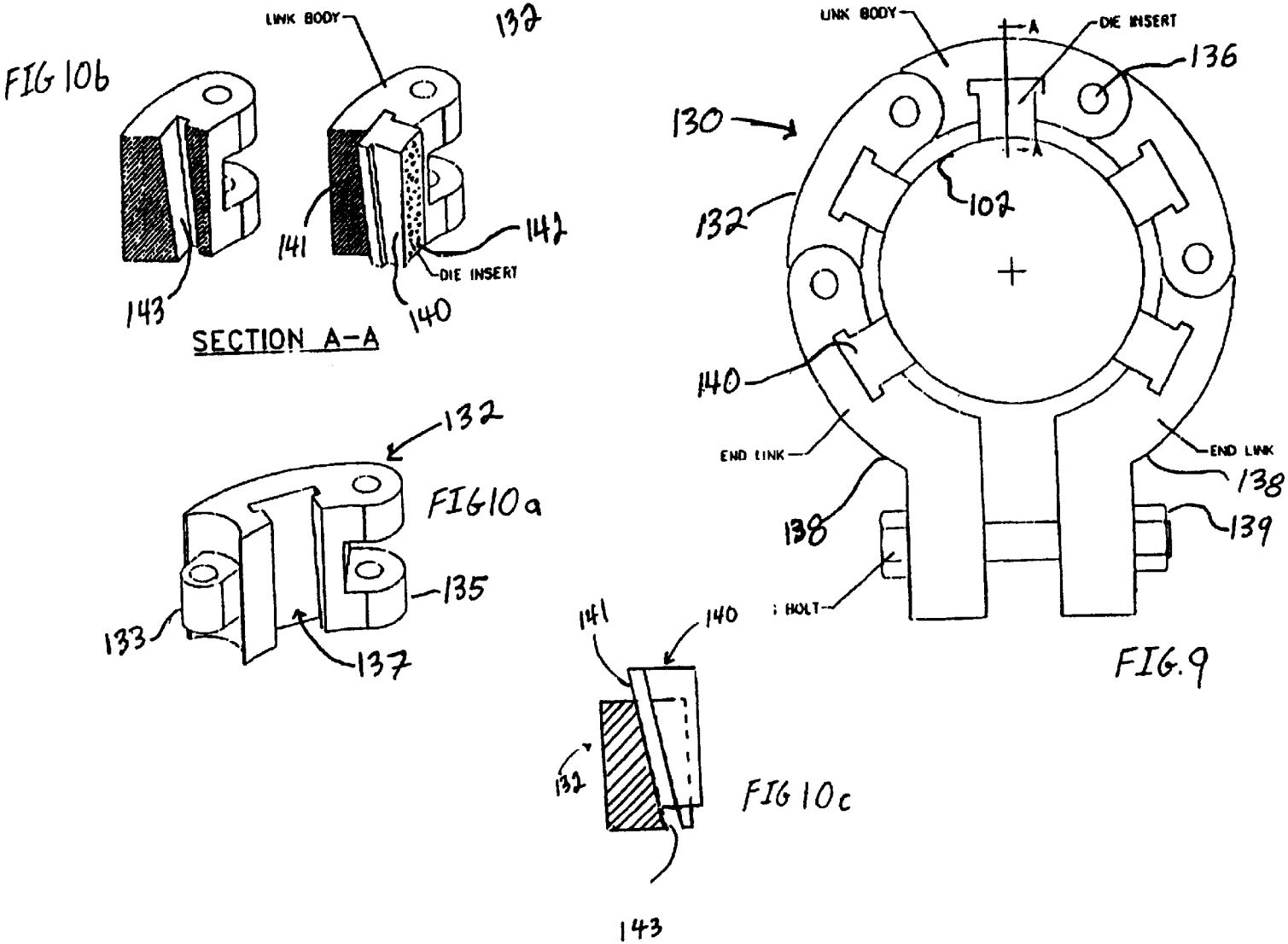
FIG. 9 is a top view of a conventional safety clamp gripping a tubular.
FIG. 10*a* is a perspective view of a link body from which the safety clamp is constructed.
FIG. 10*b* is a perspective sectional view of the link body seen in FIG. 10*a*.
FIG. 10*c* is a side sectional view of the link body seen in FIG. 10*a*.

Typically, slips and elevators described above are used in conjunction with tubulars which have a coupling or upset connection 105 as seen in FIG. 7. If for any reason the slip die inserts 115 of the slip assemblies 118 or elevator slip assemblies 113 fail to grip tubular 102 and tubular 102 begins to slide through the slips or elevators, coupling or upset connection 105 is large enough in diameter to engage the upper surface of elevator slip assembly 113 or slip assembly 118. Thus coupling or upset connection 105 acts as a back-up mechanism to prevent the drill string from ever accidentally falling below the level of rig floor 100. However, there may instances where a tubular 102 is not equipped with a coupling or upset connection 105. In such cases, a safety clamp such as seen in FIGS. 9 and 10 may be employed. Safety clamp 130 comprises a series of link bodies 132 which are joined by pins 136 to one another and to two end links 138. FIG. 10*a* illustrates the link tongue 133 which will pivotally engage the link hinge 135 of an adjacent link body 132 when pin 136 passes through the apertures in link tongue 133 and link hinge 135. As seen in FIG. 9, the two end links 138 will be joined by a clamping bolt 139 which may be adjusted to vary the radial load which die inserts 140 place on tubular 102. FIG. 10*a* illustrates how link body 132 includes a die receiving channel 137. Die receiving channel 137 is formed to receive die insert 140 shown in FIGS. 10*b* and 10*c*. Die receiving channel 137 will have a first inclined surface 143 formed thereon as seen in FIG. 10*c*. A second, supplementary inclined surface 141 is formed on the rear of die insert 140. In a manner similar to the above described slip and bowl assemblies, movement of second inclined surface 141 downward along first inclined surface 143 moves die insert 140 in an radial direction toward tubular 102. Excepting the granular particle gripping surface of the die inserts, both the slip system 110 and safety clamp 130 described above are well known in the prior art. The inventive feature claimed and described herein is the novel gripping surface for die inserts of power tongs jaws 50, slip system 110 and safety clamp 130.

Figure 3:
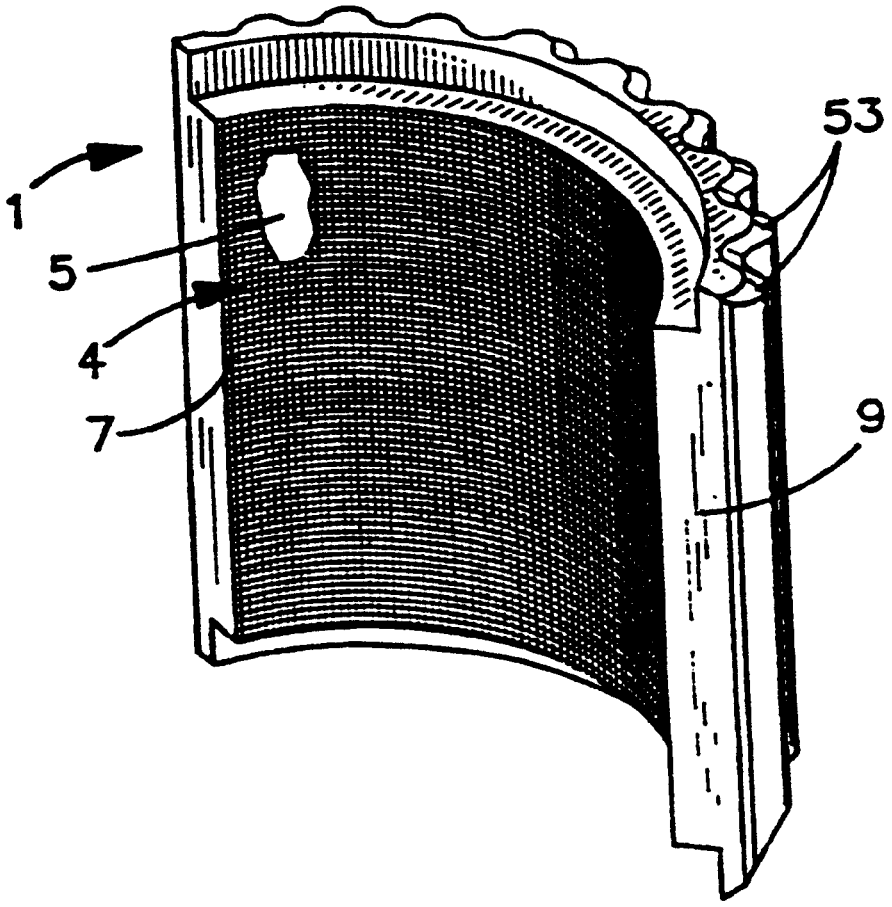
FIG. 3 is a perspective view of a die having the granular particle gripping surface of the present invention.

FIG. 3 is a perspective view of a die insert having the novel gripping surface of the present invention. In the embodiment shown, the gripping surface is formed on a die having splines 53 similar to those shown in FIGS. 2*a* and 2*b*. Die 1 in FIG. 3 generally includes a body portion 9, splines 53 formed on the rear of body 9 and a face section 4 making up the front of body 9. The gripping surface of the present invention is formed on the face section 4 of the body 9 by a coating 7 which is shown as the shaded surface portion of face section 4. The surface of face section 4 immediately below coating 7 forms the smooth backing surface 5 to which coating 7 adheres. Smooth backing surface 5 is shown in FIG. 3, where a portion of coating 7 has been removed from face section 4. Those skilled in the art will recognize that dies are manufactured in standard dimensions and it is sometimes desirable to maintain these standard dimensions despite the additional thickness coating 7 will add to the total dimension of the die 1. Therefore, in some applications it will be necessary to reduce the thickness of face section 4 by an amount equal to the thickness of the coating 7 which is applied to die 1. This insures that a die 1 of the present invention will be manufactured to the standard die dimensions used in the industry.

In general terms, coating 7 comprises a granulated particle substance which has been firmly attached to backing surface 5 to form the granular particle coating 7. The granular particle coating 7 produces a high friction gripping surface on the face 4 of die 1. In use, the dies 1 are inserted into jaw members which in turn are the component of power tongs that grip the tubular member as described above. When the jaws of the power tongs close on a tubular member as suggested by FIG. 1, the gripping surface of dies 1 is pressed against the tubular member. Over the entire surface of the die face, the granular particles are microscopically penetrating the outer most surface of the tubular member. It will be understood that because of the small size of the granular particles as explained below, it is only the outer most surface of the tubular that is being penetrated and this does not result in the comparatively deep and damaging bite marks produced by the prior art die teeth described above. However, because this microscopic penetration is occurring over the entire surface of the die, the gripping strength is substantial even without the deep penetration of the prior art die teeth. Additionally, because the granular particles are applied to the die's gripping surface by a sprinkling process described below, there is no uniform pattern in the positioning of the granular particles. Therefore, the disadvantage of uniform bite marks described above is eliminated.

A similar coating will be applied to the slip die inserts 115 and safety clamp die inserts 140. FIGS. 8*a* and 8*d* illustrate granular particle coated gripping surface 120 on slip die insert 115 and FIG. 10*b* illustrates granular particle coated gripping surface 142 on safety clamp die insert 140. It has been discovered that the granular particle gripping surface of the present invention provides a more secure initial bit when gripping tubulars than the prior art steel tooth gripping surfaces. It is believed that this superior initial bite is a result of two factors. First, the granular particles of the present invention are significantly harder than steel. Therefore, the granular particles can more readily make an initial penetration of tubular 102's outer surface. This is particularly true where tubular 102 is formed from a hardened CRA material.

Second, the granular particles will be distributed across a given size range as disclosed below. This results in the force of the initial bite being born by the larger particles which make up only a fraction of the total granular gripping surface. With only a comparatively few large particles bearing the entire radial force developed by the weight of the slip assemblies (or the force of the hydraulic cylinders) during the initial bite, these larger particles have a much greater likelihood of penetrating the outer surface and properly gripping tubular 102 before the full weight of the drill string is allowed to act on the slip assemblies. This is distinguished from the prior art steel tooth gripping surfaces which engage a tubular with all teeth simultaneously. The distribution of initial bite force equally across all the steel teeth make it less likely that the teeth will be able to obtain a secure initial bite. Lack of such a secure initial bite will result in slippage and significant damage to the tubular as mentioned above.

One embodiment of the granular particle coating and the process used to apply it to the backing surface of the die is disclosed in U.S. Pat. No. 3,024,128 to Dawson, which is incorporated by reference herein. However, other granular particles and methods of application are considered to be within the scope of this invention. The granular particles will be graded to include a wide range of sizes such as from approximately 100 microns to 420 microns in diameter. One embodiment of the invention will use granular particles in the range of approximately 300 to 400 microns. Of course these size ranges are only approximate and sizes of particles greater than 420 microns and smaller than 100 microns may be used in particular applications.

The material from which the granular particles are formed can also vary widely. In one embodiment, carbides of refractory metals were found to be suitable. Such refractory metal carbides include carbides selected from the group consisting of the carbides of silicon, tungsten, molybdenum, chromium, tantalum, niobium, vanadium, titanium, zirconium, and boron. It is envisioned that in place of carbides, borides, nitrides, silicides, and the like may be used singly or in mixtures. However, other refractory metals and metalloids may form a suitable granular particle material. There are generally two requirements for a granular particle material to be suitable for the gripping surface of the present invention. First the material must be capable of being firmly adhered to the backing surface of the die such that the large torque the die faces resist will not dislodge the particles from the backing surface. Second, the material must be sufficiently hard that the granules of the material will penetrate the outermost surface of a tubular member rather than simply being crushed between the backing surface and the tubular member. Third, the granules should not contaminate the tubulars.

As mentioned, it is necessary to adhere the granular particle material to the backing surface firmly enough that the high torque forces do not dislodged the particles from the backing surface. A preferred embodiment of the invention accomplishes this by utilizing a metal matrix or brazing alloy to fuse the granular particle material to the backing surface. The metal matrix preferably has a melting or fusing point lower than the melting or fusing point of the granular particle material or the backing surface. Typical brazing alloys could include cobalt-based and nickel-based alloys, notably those containing significant proportions of chromium. Alternatively, copper, copper oxide or a copper alloy such as bronze can be used. However, when dealing with tungsten-carbide grit particles, copper alloys are not the preferred brazing material. The brazing alloy may also contain boron, silicon, and phosphorus. Suitable brazing materials are available commercially and can be used in their commercially available forms.

Several preferred processes for applying the granular particle coating to the die face are disclosed in U.S. Pat. Nos. 3,024,128 and 4,643,740, which is also incorporated by reference herein. Generally the metal matrix or brazing alloy and the refractory particles are applied to the backing surface of the die and the die is heated to a temperature sufficient to cause the metal matrix to reach a liquid or semi-solid state. When the metal matrix cools from the liquid or semi-solid state, the granular particles will be firmly bonded or fused to the backing surface. In practical application, the process begins by cleaning the die backing surface to remove grease or scale from the backing surface. Next a temporary adhesive or binder material is applied to the backing surface to which the metal matrix and the refractory particles will adhere until heating of the die takes place. The temporary adhesive may be a volatile liquid vehicle, such as water, alcohol, or mixtures thereof, or the like which can be volitized and dried readily. This allows the temporary adhesive to be applied by a spray on process, roller type applicators, or by any other conventional manner. "Shellac" as disclosed in U.S. Pat. No. 3,024,128 is one such temporary adhesive. After application of the temporary adhesive, the metal matrix and refractory particles will applied be to the backing surface. The metal matrix and refractory particles are will typically be in a powder form and generally sprinkled in a thin layer onto the backing surface. The sprinkling process can be carried out by any number of machines such as the electro-magnetically vibrated feeder as disclosed in column 5 of U.S. Pat. No. 3,024,128. Generally, some conventional method is used to insure any excess powder is not retained on the backing surface. For example, the backing surface may be positioned at an angle during the sprinkling process such that only the thin layer of powder actually contacting the adhesive remains on the backing surface and any excess powder falls from the backing surface. In this manner, the thickness of the final granular coating maybe no greater than the diameter of the largest granular particles.

Prior to the die being heated, a flux agent is also added to the backing surface or premixed with the brazing compound. The flux agent tends to give fluidity to the heated materials, tends to lower the melting point of the high melting oxides, and provides protection against unwanted oxidation. The flux covers or envelops the backing surface to protect it from oxidation by the atmosphere while heating. It also dissolves any oxides formed on the metallic surfaces, lowers the surface tension of the molten or plasticize matrix to allow it to flow or spread sufficiently to coat all adjacent parts or particles to form a fusion bond between the particles and the backing surface. Those skilled in the art will recognize a wide variety of commercially available flux agents may be used. In a preferred embodiment, fluoride based fluxes and borax/boric acid mixtures were found suitable. The flux may be applied to the backing surface after application of the refractory particle/metallic matrix powder or it may be mixed with the powder before its application to the backing surface.

After the refractory particle/metallic matrix powder and the flux have been applied to the backing surface, the die will be subject to a heating process. There are numerous heating processes that may be used fuse the refractory particles to the backing surface. For example, U.S. Pat. No. 3,024,128 discloses heat could be applied by a welding torch for small production runs. For larger production, gas fired or electric furnaces could be used. In these heating methods, a protective atmosphere such as a reducing or carburizing atmosphere is typically used. However, with rapid heating methods such as induction furnace heating, it may not be necessary to utilize a protective atmosphere. Another alternative heating method is disclosed in U.S. Pat. No. 4,643,740. This patent describes a heating method wherein a source of electric current is connected to the article to be heated and a current sufficient to heat the article to the required temperature is then passed through the article. The temperature required to melt the brazing matrix will vary depending on the material employed, but a temperature range of approximately 600° C. to approximately 1400° C. is appropriate for many conventional brazing materials. While the preceding disclosure described certain preferred methods of applying the granular particle coating to the backing surface of the die, those skilled in the art may recognize other suitable methods. However, other brazing materials such as lead and tin based brazing alloys may melt at temperatures as low as about 150° C. These are intended to be included within the scope of the present invention.

After heating of the brazing material and subsequently allowing to cool, the dies may be considered ready for use with no further treatment. In other words, the dies may be used while the backing surface is in the annealed state. Alternatively, in certain applications, it may be desirable to subject the dies to conventional heat treating techniques to achieve a backing surface somewhat harder than the annealed state. These heat treating techniques could include quenching in a water or oil bath. Still further, the dies could be cooled and then reheating in a conventional tempering process. All such variations are intended to come within the scope of the present invention.

Applicant has discovered that the present invention produces a significantly higher coefficient of friction between the tubular and the die face. This higher coefficient of friction allows the present invention to firmly grasp the tubular member under substantially higher torque loads than prior art methods. For example, the die of the present invention can obtain without slippage approximately double the torque obtained in the silicon carbide screen method described above. It is believe that this superior gripping ability is at least partially a result of the heating process the die inserts undergo during application of the granular particle coating to the underlying steel face 5. The heating process causes the underlying metal face of the die insert to "anneal," or become somewhat softer, to a hardness value in the range of approximately 70 HRB. Thus, when the die insert is pressed against a harder tubular under large radial forces during use, the granular particles tend to become partially embedded in the underlying metal on the face of the die insert. Therefore, the shear forces imparted to the granular particles when torque or vertical load is applied to the tubular is resisted not only by the brazing alloy, but also by the portion of the particle embedded in the die insert surface.

Figure 4:
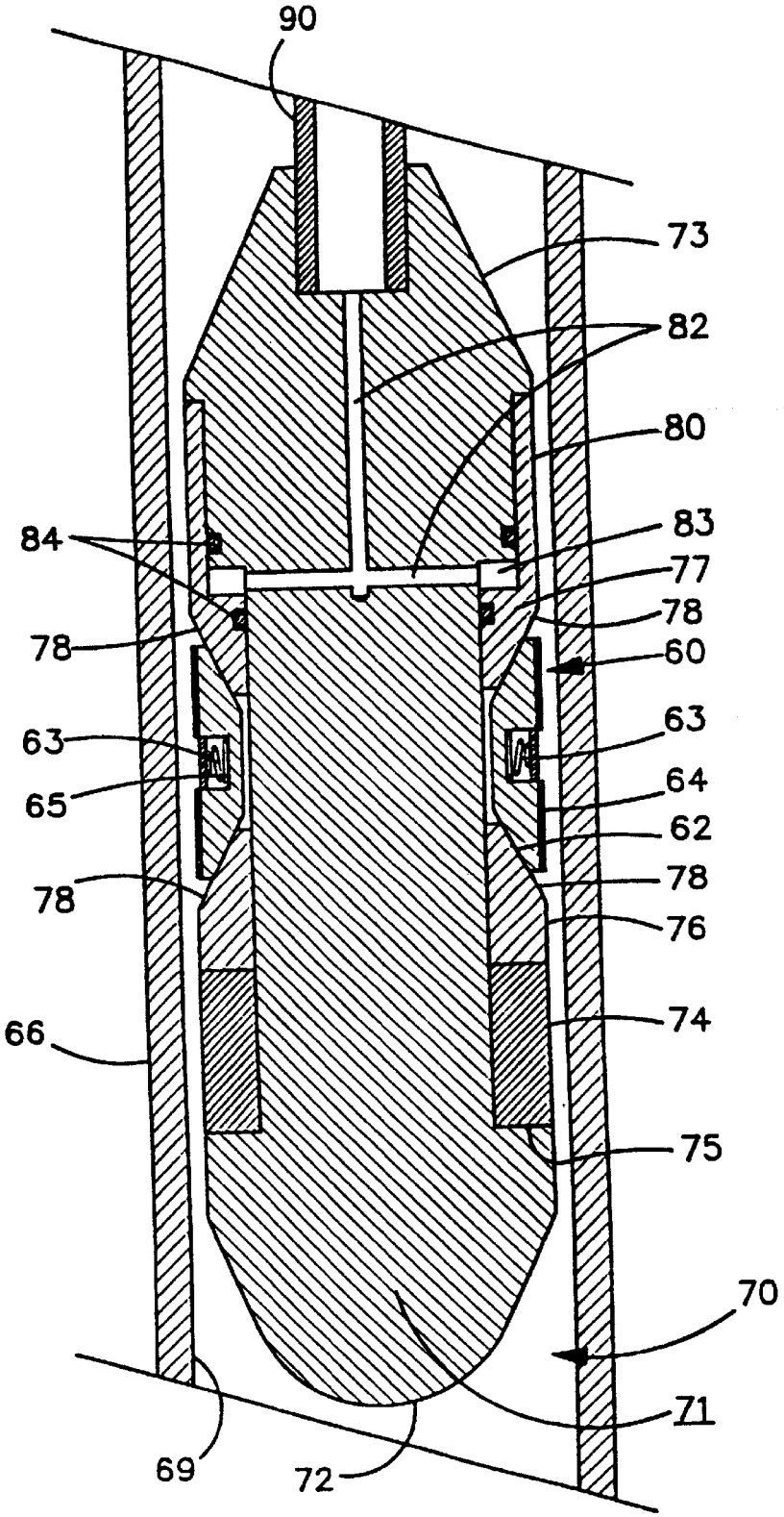
FIG. 4 is a cross-sectional view of an alternate embodiment of the present invention which comprises a set of bridge plug slips having a granular particle gripping surface.

FIG. 4 illustrates an alternate embodiment of the present invention which will be used in conjunction with a conventional bridge plug 70. Bridge plug 70 is designed to be inserted into casing or tubing such as tubular 66 and then activated in order to block the flow of fluid through tubular 66. Bridge plug 70 typically comprises a plug body 71 having an upper section 73 and a lower section 72. While not shown in detail in FIG. 4, upper section 73 will be adapted in a conventional manner for attachment to a work string 90 which will allow bridge plug 70 to be lowered down the well bore and to be positioned at the desired depth of placement. Lower section 72 forms a head portion with shoulders 75 against which a rubber packing element 74 will rest. Positioned above packing element 74 is a lower expansion cone 76 and further above cone 76 is an upper expansion cone 77. Both upper and lower expansion cones 76 and 77 will have inclined surfaces 78. It will be understood that both expansion cones 76 and 77 and packing element 74 are annular shaped and extend continuously around the plug body 71 as a single element.

Figure 5:
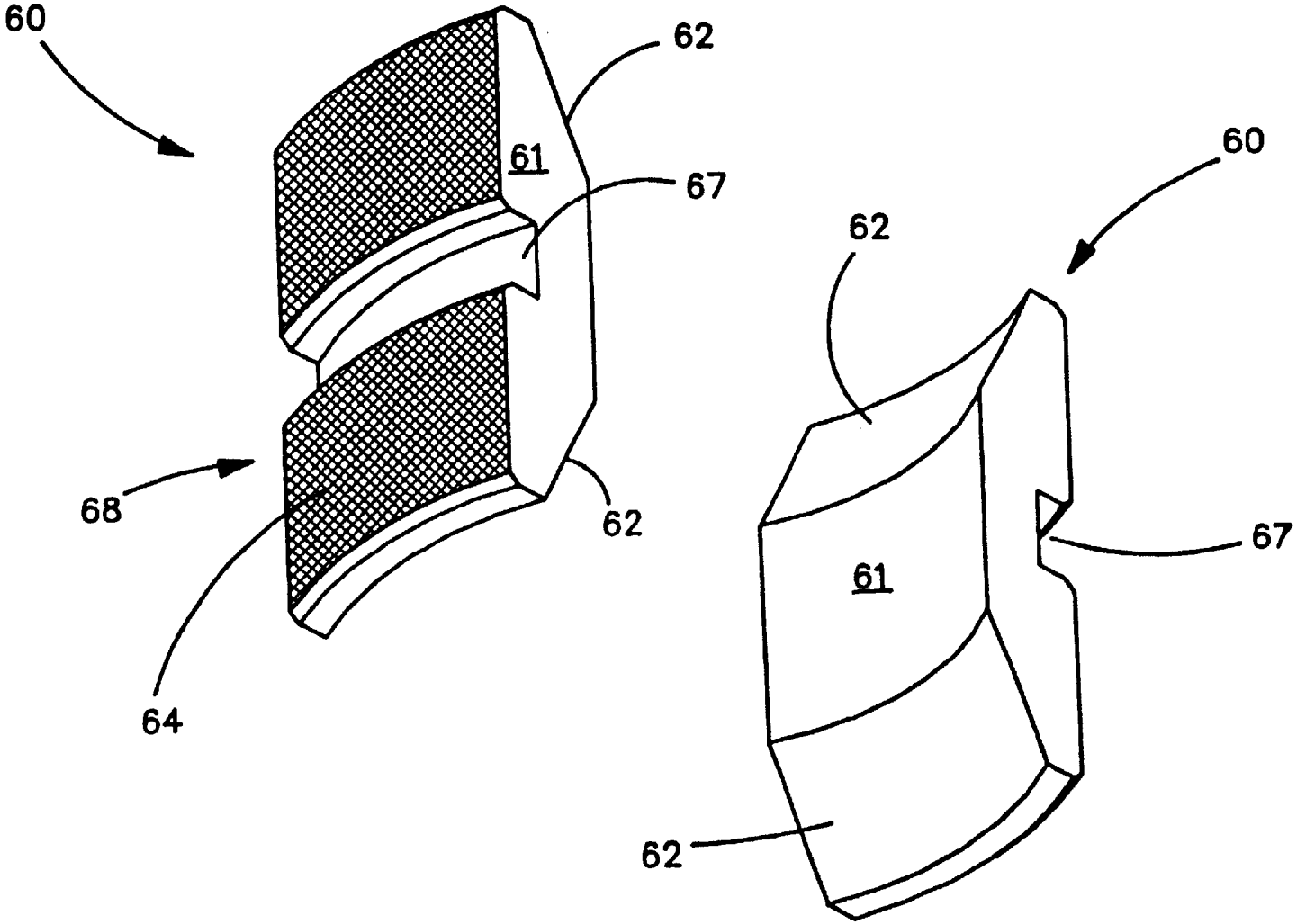
FIG. 5 is a perspective view of one slip according to the present invention.

Positioned between expansion cones 76 and 77 are a series of slips 60. Unlike expansion cones 76 and 77 and packing element 74, slips 60 do not form a continuous annular element around plug body 71. Rather slips 60 are a series of separate arcuate segments which are positioned around plug body 71. An opposing pair of such arcuate segments is seen in the slips 60 illustrated in FIG. 5. In the bridge plug 70 of FIG. 4, there are six slips 60, but alternate embodiments could employ fewer or more slips 60. Each slip 60 will have a body 61 with inclined surfaces 62 at each end of body 61. Slip body 61 will also have an outer convex surface 68 and a slip ring channel 67. As seen in FIG. 4, a slip retaining ring 63 will rest in ring channel 67 and encircle the plurality of slips 60. A slip spring 65 will be positioned between slip retaining ring 63 and ring channel 67 and will bias slips 60 away from the inner surface of tubular 66 to insure slips 60 do not unintentionally or prematurely move toward and grip the inner surface of tubular 66. FIG. 4 also illustrates how inclined surfaces 62 of slips 60 will correspond to and travel along inclined surfaces 78 of upper and lower cones 76 and 77. Returning to FIG. 5, it can be seen that slips 60 will have a granular particle coating 64 covering the outer convex surface 68 of slips 60 which will engage the inner surface 69 of tubular 66 as described below. The granular particle coating 64 is identical to granular particle coating 7 described above for dies 1 and granular particle coating 64 my be applied to slips 60 by any of the methods disclosed above.

Directly above upper cone section 77, a setting piston 80 is formed by another arcuate element which extends continuously around plug body 71. In the illustrated embodiment, setting piston 80 is integrally formed on upper cone section 77. A variable volume fluid cavity 83 is formed between setting piston 80 and plug body 71. Fluid cavity 83 will communicate with fluid a channel 82 which runs through upper section 73 of plug body 71 and allows fluid to be transmitted from the work string, through plug body 71, to fluid cavity 83. Conventional seals such as O-rings 84 will form a fluid tight seal between setting piston 83 and plug body 71.

Figure 6:
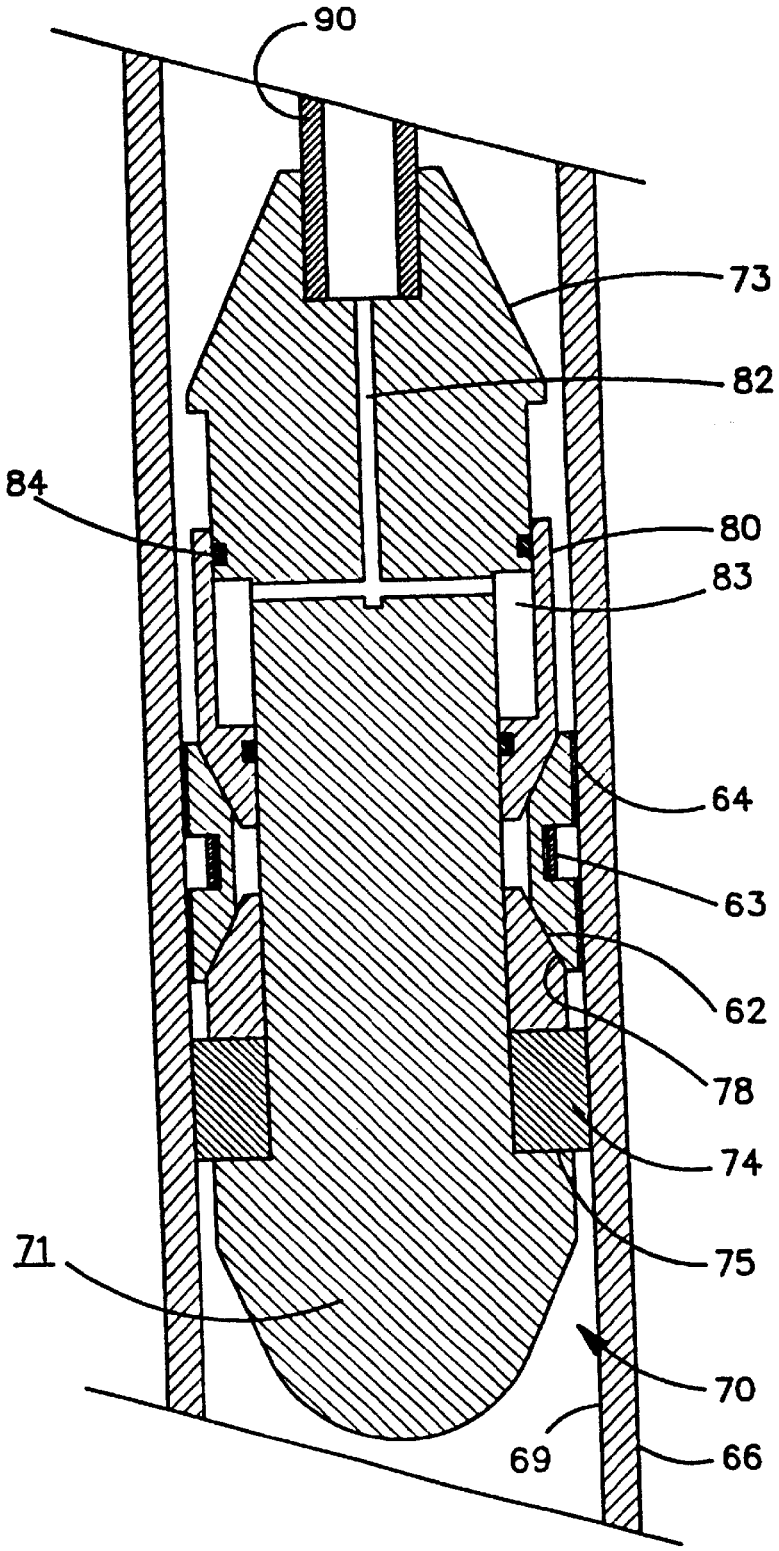
FIG. 6 is a cross-sectional view the bridge plug of FIG. 4 illustrating the bridge plug in an activated position.

In operation, bridge plug 70 is positioned on a work string and lowered down the well bore to the depth at which it is desired to plug the tubing or casing. While bridge plug 70 is being lowered down the well bore, it is in the unactivated position as seen in FIG. 4. After bridge plug 70 is lowered to the desired depth, it will be activated by pumping pressurized fluid through the work string into channel 82. The fluid will accumulate in variable fluid cavity 83 and begin moving setting piston 80 downward as seen in FIG. 6. Setting piston 80 will in turn force upper expansion cone 77 downward causing incline surfaces 78 on upper and lower expansion cones 77 and 76 to slide along inclined surfaces 62 of slips 60. This movement will force lower expansion cone 76 against rubber packing element 74, causing it to expand against the inner surface 69 of tubular 66 and thereby sealing or pugging tubular 66. Simultaneously, the movement of inclined surfaces 78 of upper and lower expansion cones 76 and 77 along inclined surfaces 62 of slips 60 will cause slips 60 to overcome the tension in slip spring 65 and move toward and eventually engage the inner surface 69 of tubular 66. When slips 60 engage tubular 66, the granular particle surface 64 will become embedded against the inner surface 69 of tubular 66 and slips 60 will be capable of resisting the high oil or gas formation pressures that might otherwise dislodge bridge plug 70. The granular particle surface 64 provides the same advantages disclosed above in reference to dies 1 such as providing a more slip resistant gripping surface and reducing damage and scaring to tubular members.

While not illustrated in the figures, slips 60 maybe used in conjunction with devices similar to bridge plugs, such as packers used for production, isolation, testing and stimulation. Packers are structurally similar to bridge plugs except that packers contain one or more internal passages to allow a regulated flow of fluid through the packer or to accommodate instrument wires or control lines which must pass through the packer. Those skilled in the art will recognize that there are also bridge plugs and packers that are activated by means other than the hydraulic mechanism described above. Slips 60 are equally suitable for use in bridge plugs or packers which are activated by mechanical means, wirelines, electric wirelines or other conventional methods used to operate the downhole tools typically found in the drilling industry.

Figure 12A:
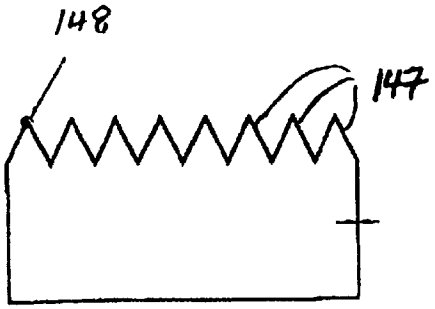
FIG. 12*a* is a section representation of coated die teeth of the present invention.
Figure 12B:
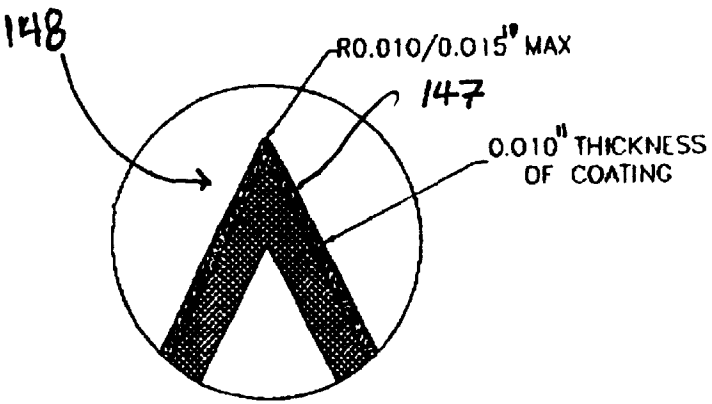
FIG. 12*b* is a detailed view of a single coated die tooth of the present invention.
Figure 11A:
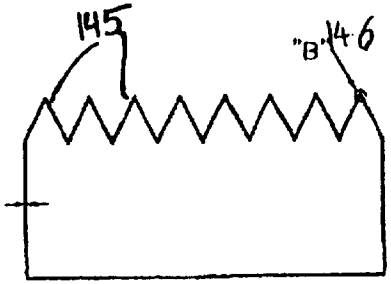
FIG. 11*a* is a sectional representation of conventional steel teeth used in die inserts.
Figure 11B:
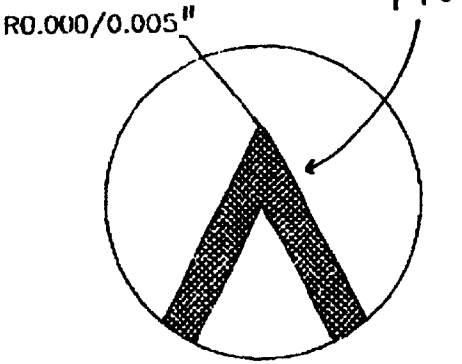
FIG. 11*b* is a detailed view of a single steel tooth seen in FIG. 11*a*.

Another embodiment of the present invention does not replace the steel teeth on conventional die inserts with the above described granular particle coating, but rather uses the coating in combination with conventional steel teeth. FIG. 11*a* is a cross-section of a conventional tooth pattern such as shown on the die insert 51 of FIG. 2*a*. For simplicity, FIG. 11*a* makes no attempt to show the shape of any particular die insert, but rather is intended to represent a cross-section of conventional teeth that might appear on any type of conventional die insert. As the detail of an individual tooth 146 seen in FIG. 11*b* illustrates, the typical steel tooth has a sharp point, with a representative radius between 0.000 mm to 0.125 mm (0.000 to 0.005 inches). Typically, prior art steel teeth are further hardened through a carburizing process. While it is desirable to have a gripping surface which will achieve a secure initial bit as described above, it is not desirable to have excessively deep penetration into the tubular as the radial load on the tubular increases. However, the sharp point on steel tooth 146 does cause excessive penetration and consequently damaging marking of the tubular surface. It has been discovered that a novel and significantly improved tooth pattern can be obtained by applying a granular particle coating 147 over the conventional teeth 145 as seen in FIG. 12*a* and in the detailed section of FIG. 12*b* illustrating coated tooth 148. One preferred embodiment of granular particle coating 147 will be applied as described above, but could comprise particles in a size range of approximately 37 microns to 250 microns and most preferredly will comprise granular particles in a size range from approximately 145 to 165 microns. A preferred thickness of the granular particle coating 147 upon the tooth surface is 0.25 mm (approximately 0.010 inches). However, obvious variations of this thickness, including as an example a range of 0.05 mm to 0.46 mm, is intended to fall within the scope of the present invention. After the application of a coating thickness of approximately 0.25 mm, the point of the tooth 148 will be more rounded, and have a radius of approximately 0.25 mm to 0.375 mm (0.010 to 0.015 inches). During the process of applying the granular particle coating 147, the die insert must be heated to a sufficiently high temperature to allow the brazing alloy to melt and bond the granular particles to surface of the teeth 148. As mentioned above, this heating and cooling process associated with applying the brazing alloy may cause the steel forming teeth 148 to "anneal" or become softer. Because of the large stresses placed on steel teeth 148 when the die inserts grip tubulars, it is desirable to return the steel forming teeth 148 to its original hardness. This is accomplished by subjecting the coated die inserts to a conventional quench and temper process. The details of conventional quench and temper processes are well known in the art and need not be recited herein. It is preferred that the conventional quench and temper process be sufficient to restore the steel's hardness to approximately 58 to 62 HRC (Rockwell Hardness Scale "C") which is still softer than the granular particle media.

The application of a granular particle coating over the steel toothed die insert provides a number of advantages over a die insert having only naked steel teeth. Where the granular particle coating 147 comprises a non-ferrous (e.g. nickel-based) brazing alloy in combination with non-ferrous particles (e.g. tungsten carbide), a CRA tubular will be protected from the iron in the steel teeth coming into contact with and contaminating (or inducing iron based oxidation) in the CRA tubular. Additionally, as discussed above, the granular particle coating reduces the sharpness of the steel teeth. This reduces the penetration of the teeth into the tubular surface and tubular damage which may be associated therewith. Experimentation has shown that the die insert teeth covered with the granular particle coating have a 30% lesser penetration depth into the tubular surface than do naked steel teeth. This lesser penetration results in shallower "bite marks" on the tubular and correspondingly less damage to the tubular. Moreover, the granular particle coating protects the underlying teeth and these teeth retain their initial sharpness far longer than naked steel teeth. While naked steel teeth on newly formed dies are sharper than the coated teeth of the present invention, the naked steel teeth eventually become so worn through use that the teeth actually become too blunt to effectively grip the tubular. Therefore, a naked steel toothed die insert has a life cycle starting out with the teeth being too sharp and then degrades to a point where the teeth are too blunt. The granular particle coated teeth begin their life cycle with a desirable degree of sharpness and maintain that sharpness for a far greater time period than a naked steel tooth. It has been found that the granular particle coated teeth 148 are particularly effective when gripping tubulars which have a heavy coating of paint, scale or other material. When such conditions exist and a smooth face die insert with granular particle coating (such as seen in FIGS. 3, 8*d*, and 10*b*) is employed, the paint or scale may have a tendency to "clog up" the spaces between individual granular particles. This may reduce the gripping effectiveness of the smooth faced granular coated die inserts. However, the comparatively larger and deeper spacing between individual coated teeth 148 provides sufficient room for the clogging material to be dispersed. Thereby preventing the gripping effectiveness of coated teeth 148 from being seriously impaired.

Figures 13A, 13B:
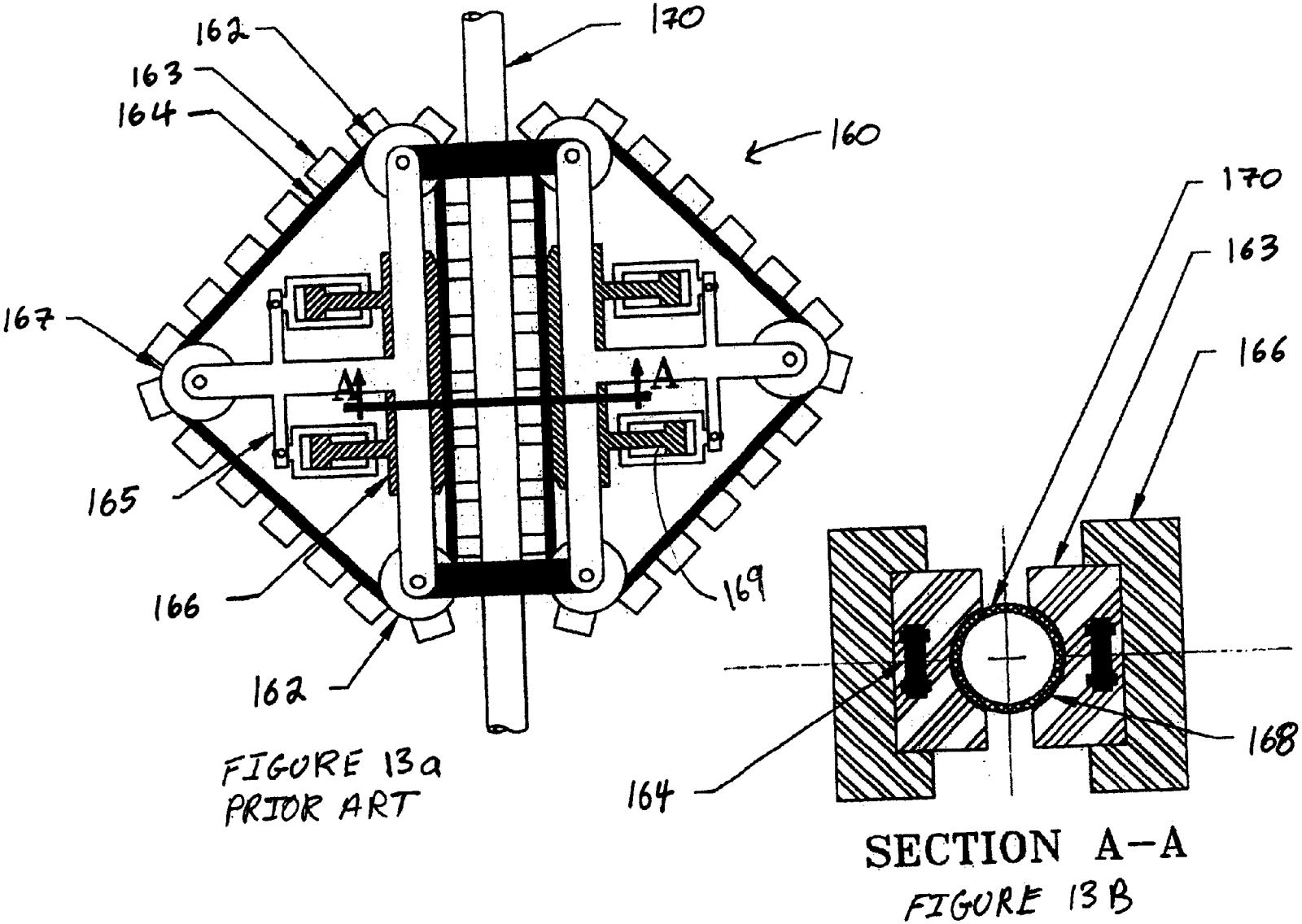
FIGURE 13a PRIOR ART
FIG. 13*a* illustrates a conventional coil tubing injector apparatus.
FIG. 13*b* illustrates the present invention used in conjunction with a coil tubing injector block.

Another alternate embodiment of the present invention includes employing the granular particle coating in conjunction with a coil tubing injector. FIG. 13*a* illustrates a conventional coil tubing injector 160. Injector 160 includes idler gears 162 and drive gears 167 which engage and move chain 164 in a continuous loop fashion. Positioned along chain 164 are a series of injector blocks 163. The injector blocks 163 will have arcuate surfaces for gripping the coil tubing 170 as best seen in the sectional view of FIG. 13*b*. As injector blocks 163 move into a position to engage coil tubing 170, injector blocks 163 will be forced against coil tubing 170 by press wall 166 and thereby securely grip coil tubing 170 between opposing injector blocks 163 as seen in FIG. 13*b*. Load control cylinders 169 are capable of placing an adjustable load on press walls 166 and thereby regulate the gripping force which injector blocks 163 apply to coil tubing 170. All of the above described operation of coil tubing injector 160 is known in the art.

However, it is a novel concept to apply a granular particle coating to injector blocks 163 which grip coil tubing 170. The granular particle coated surface 168 is illustrated applied to the arcuate surface of the injector blocks 163 shown in FIG. 13*b*. The granular particle coated surface is then capable of gripping coil tubing 170 in a similar manner as described above in relation to rigid drill pipe tubulars and in a far more secure manner than prior art injector blocks 163.

Figure 14:
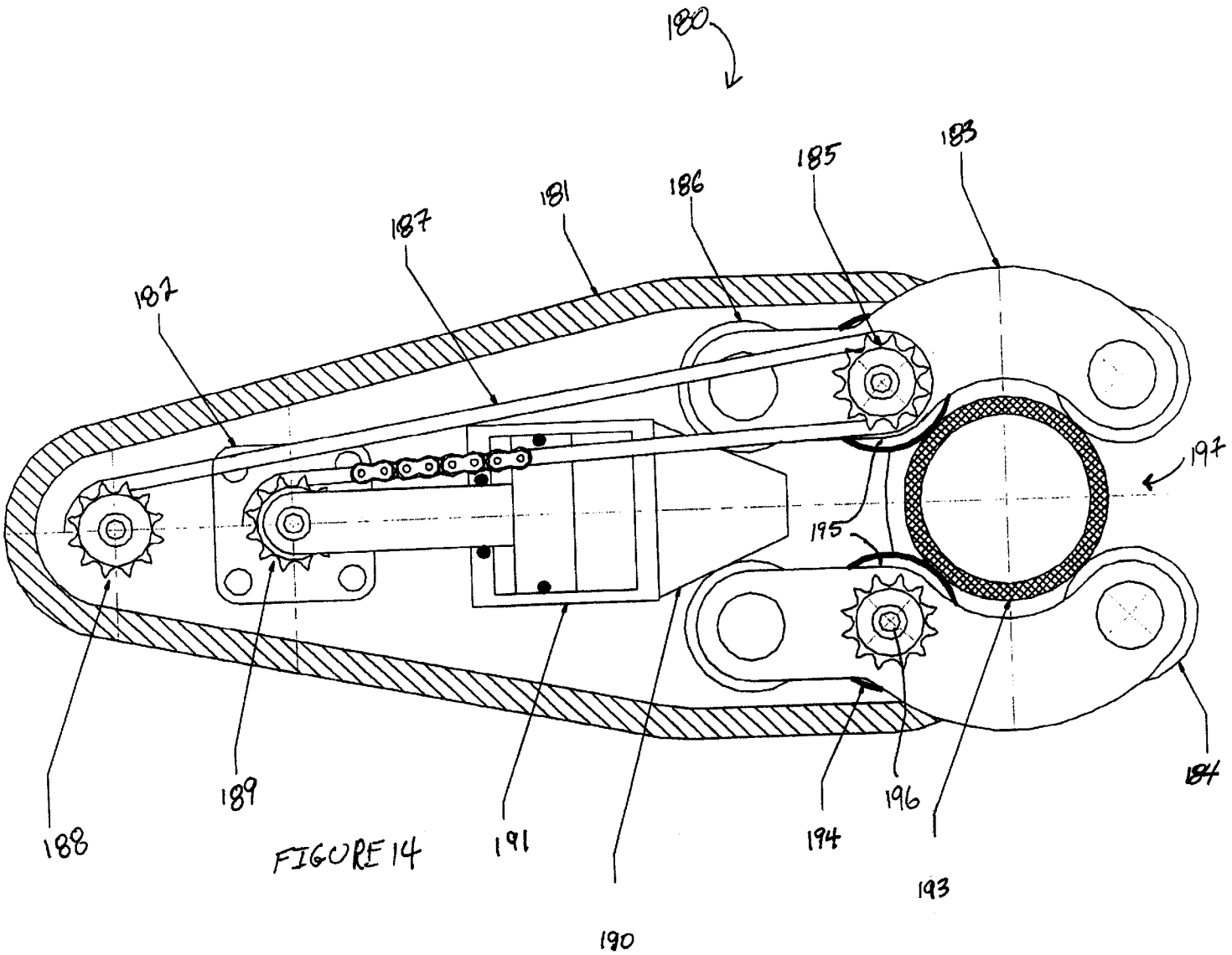
FIG. 14 illustrates the present invention used in conjunction with a pipe spinner apparatus.

A still further embodiment of the present invention is seen in FIG. 14. FIG. 14 illustrates a pipe spinner which is used to apply a comparatively high speed (approximately 80 to 100 rpm), low torque spin to a tubular in order to quickly engage the full length of threads on the connecting joint of the tubular. A manual pipe tong will typically then be used to apply the last bit of high torque rotation required for a tight connection. Pipe spinner 180 will generally comprises a spinner body 181 and two pinch roller arms or doors 183 which will form the throat 197 of pipe spinner 180. Pinch roller doors 184 will be pivotally mounted to body 180 by door pivot shafts 196. A rear door roller 186 will be mounted on the rear ends of doors 183 and a pinch roller 183 will be mounted on the front ends. Mounted between rear door rollers 186 and pinch rollers 184 will be drive rollers 195. Drive rollers 195 will rotate on pivot shafts 196, but will be fixed to drive roller sprockets 185. Spinner body 181 will also contain a motor 182 which supplies torque to motor sprocket 189. A drive chain 187 (only half of which is shown in FIG. 14) interconnects drive roller sprockets 185, motor sprocket 189, and idler sprocket 188, such that torque may be transferred from motor 182 to drive rollers 195. The pinch roller doors 183 (and thus throat 197) will be opened and closed on a tubular 193 by operation of roller wedge 190, which in turn is connected to hydraulic cylinder 191. It will be readily apparent that pinch roller doors 183 will be moved into the closed position (as seen in FIG. 14) when roller wedge 190 advances and forces rear door rollers 186 outward, thus causing doors 183 to rotate on pivot shaft 196 and pinch rollers 184 to move inward closing against tubular 193. Likewise, the retraction of roller wedge 190 will allow rear door rollers 186 to move inward and pinch rollers 184 to move into the open position. While not shown in FIG. 14, a biasing device such as a spring will typically bias rear door rollers 186 together such that roller doors 183 will move to the open position when roller wedge 190 is not engaging rear door rollers 186. The above description of pipe spinner 180 represents a typical prior art pipe spinner.

However, prior art pipe spinners normally use drive rollers with smooth surfaces which are not able to apply adequate make-up or break-out torque to tubular 193 without slipping. An improved and novel pipe spinner 180 may be constructed by forming a granular particle coating 194 on drive roller 195. Granular particle coating 194 significantly increases the ability of drive roller 195 to impart sufficient torque to tubular 193 to make-up or break-out at least some tubular connections.

The above embodiments disclose adhering the granular particle coating to the die backing surface through the use of a metal brazing matrix which melts at a temperature above the transformation range of the metal. The transformation range is the temperature range in which metals undergo internal atomic changes which affect properties of the metal such as hardness. For example, the transformation range of steel begins at around 700° C. and will vary based upon factors such as the percent carbon in the steel. The beginning of the transformation range will be referred to as the transformation starting temperature. Naturally, the transformation range and thus the transformation starting temperature will vary for different metals.

The present invention also includes employing metal brazing matrices which melt near or below the transformation starting temperature of the particular metal be utilized to form the die backing surface. These lower melting point brazing matrices include alloys formed from lead, tin, antimony, silver, zinc, copper, aluminum or combinations thereof. For example, lead/tin alloys have a melting temperature of approximately of 182° C. to 238° C., tin/zinc alloys have a melting temperature of approximately of 199° C. to 250° C., tin/antimony alloys have a melting temperature of approximately of 182° C. to 238° C., tin/silver alloys have a melting temperature of approximately of 211° C. to 279° C., aluminum alloys have a melting temperature of approximately of 588° C. to 657° C., silver alloys have a melting temperature of approximately of 595° C. to 795° C., and copper/phosphorus alloys have a melting temperature of approximately of 645° C. to 880° C.

When employing a metal brazing matrix with a melting temperature significantly above the transformation starting temperature, the heat required to melt the brazing matrix is often sufficient to soften the metal of the backing surface to a hardness less than the granular particles. For example, one preferred type of particles have a hardness of approximately 96 to 98 hardness on Rockwell "A" scale (HRA). However, when employing a brazing matrix with a melting temperature near or below the transformation starting temperature, it is necessary to employ a metal backing surface with a pre-existing hardness which is less than the approximate hardness of the granular particles. This is because the heat needed to melt the brazing matrix is not expected to soften the metal. Thus, the metal backing surface used in conjunction with low temperature brazing matrices should have a pre-existing hardness which is significantly less than the granular particles. In one embodiment, the hardness of the metal backing surface could be approximately 70 hardness on Rockwell "B" scale (HRB), but could range as low as (or even lower) than approximately HRA 44. As discussed above, the lower hardness of the die backing surface will allow the granular particles to become partially embedded within the backing surface when a tubular is gripped by the dies with sufficient radial force.

The scope of the present invention also includes adhering the granular particle coating with either non-melting or non-metal adhesives. Generally, these substances will be considered low temperature curing adhesives. In other words, these adhesives will not need a high melting point in order to rigidly adhere the granular particle coating to the die backing surface. While some such adhesives may experience an exothermic reaction while setting or curing, this temperature will be very low compared to the melting point of most metals. Low temperature curing adhesives as used in the present disclosure will cure or set-up at temperatures of less than about 100° C. Examples of such low temperature curing adhesives include thermoset resins (a.k.a. hot melt glue), catalyst cured resin (a.k.a. epoxy), evaporative solvent elastomeric adhesives (a.k.a. contact cement), catalyst cured elastomeric adhesives (a.k.a. urethanes). As with the lower temperature metal brazing matrices, a low temperature curing adhesive requires the use of a metal backing surface with a pre-existing hardness which is less than the approximate hardness of the granular particles.

A still further method of applying granular particles to a backing surface is through thermal spraying. Thermal spraying is well known in the art and is commercially used to produce a wide variety of coatings for various applications. Thermal spraying encompasses a group of processes that are capable of rapidly depositing metals, ceramics, plastics, and mixtures of these materials. Thermal spray processes can be grouped into three major categories: plasma-arc spray, flame spray, and electric wire-arc spray. These energy sources are used to heat a coating material (in powder, wire, or rod form) to a molten or semi-molten state. The resultant heated particles are accelerated and propelled toward a prepared surface by either process gases or atomization jets. Upon impact, a bond forms with the surface and subsequent particles cause thickness buildup. The main element that thermal spray processes have in common is that they all use a heat source to convert powders or wires into a spray of molten (or sometimes semi-molten) particles. This heat source is either electrical or chemical (combustion). With all processes, the substrate is usually not heated above (250° F.), and therefore no distortion of the substrate takes place.

A preferred embodiment of the present invention would use a powdered metal matrix in the thermal spraying process. Granular particles would be mixed with the powdered metal matrix. A conventional thermal spray gun is employed which has a nozzle (similar to a welder's heating torch) which burns oxygen and acetylene achieving temperatures above the melting point of the brazing matrix but below that of the granular particles. The combination of brazing matrix powder and granular particles is fed through the center of the nozzle into the flame where the brazing matrix is melted. Compressed, high velocity oxygen or air is concentrated around the flame atomizing the molten material into fine spherical particles and propels the molten brazing particles and the granular particles at high velocity onto a the die backing surface. By controlling the rate of feed of the powder through the flame, the melt and atomization of brazing matrices with various melting points may be controlled. While a powder flame spray process is described above, it is anticipated that other forms of thermal spraying such as arc wire spaying, wire or rod flame spraying, plasma spaying, or high velocity oxygen-fuel (HVOF) spraying could also be employed.

Finally, while many parts of the present invention have been described in terms of specific embodiments, it is anticipated that still further alterations and modifications thereof will no doubt become apparent to those skilled in the art. It is therefore intended that the following claims be interpreted as covering all such alterations and modifications as fall within the true spirit and scope of the invention.

I claim:

1. A method of gripping an oilfield tubular member without damaging said tubular member, comprising the steps of:

a. providing an oilfield tubular member;

b. providing a tubular gripping system which includes a die body shaped to be inserted into a said tubular gripping system, said die body being produced by the steps of:

i. providing a metal backing surface formed on said die body, said metal having a first hardness;

ii. coating at least a portion of said backing surface a granular particle coating and a brazing matrix;

iii. heating said die body until said brazing matrix melts, thereby adhering said granular particles to said backing surface and softening said metal to a second lesser hardness; and c. placing an axial or radial load on said die body sufficient to embed a portion of said granular particles in said granular particle coating into said backing surface.

2. A method according to claim 1, wherein said step of heating said die body includes heating said die body at a temperature of about 150° C. to about 1400° C.

3. A method according to claim 1, wherein said step of heating said die body includes heating said die body at a temperature of about 600° C. to about 1400° C.

4. A method according to claim 1, wherein said step of providing a tubular member includes providing a tubular member which has a hardness of at least approximately 18 HRC.

5. A method according to claim 4, wherein said step of providing a gripping system includes providing a soften backing surface which has a hardness of approximately 70 HRB.

6. A method according to claim 1, wherein said step of placing an axial load is insufficient to reduce the diameter of said tubular member.

7. The method of claim 1, wherein said step of providing a tubular gripping system includes providing an arcuate shaped die and a granular particle coating formed of a refractory metal.

8. The method of claim 1, wherein said step of providing a tubular gripping system includes providing a power tong tool for gripping tubular members.

9. The method of claim 1, wherein said step of providing a tubular gripping system includes providing a conventional slip assembly for gripping tubular members.

10. The method of claim 7, wherein said step of providing an arcuate shaped die includes selecting said refractory metal from the group consisting of the carbides of silicon, tungsten, molybdenum, chromium, tantalum, niobium, vanadium, titanium, zirconium, and boron.

11. The method of claim 1, wherein said step of providing a gripping system includes forming said granular particle coating from granular particles in the size range of approximately 300 to approximately 420 microns.

12. The method of gripping an oilfield tubular according to claim 1, wherein said step of heating includes heating said metal matrix to a temperature sufficient to cause said metal matrix to reach at least a semi-solid state.

13. A method for producing a die insert for engaging tubular members comprising the steps of:

a. providing a metal die body having a first hardness and an arcuate shape corresponding to the curvature of an oilfield tubular member having a standard diameter, said die body further having a backing surface formed thereon;

b. coating at least a portion of said backing surface a granular particle coating and a brazing matrix; and c. heating said die body until said brazing matrix melts, thereby adhering said granular particles to said backing surface and softening said metal to a second lesser hardness, such that said backing surface may engage an oilfield tubular member with sufficient force to embed said granular particles in said backing surface without reducing the standard diameter of the tubular member.

14. A method according to claim 13, wherein said step of heating said die body includes heating said die body at a temperature of about 150° C. to about 1400° C.

15. A method according to claim 13, wherein said step of heating said die body includes heating said die body at a temperature of about 600° C. to about 1400° C.

16. The method according to claim 13, wherein said step of providing a die body includes providing a die body having a concave arcuate shape for gripping the outer perimeter of a tubular member.

17. The method according to claim 13, wherein said step of providing a die body includes providing a die body having a convex arcuate shape for gripping the inside perimeter of a tubular member.

18. The method according to claim 13, wherein said step of heating includes heating said granular particle coating and said a brazing matrix to a temperature sufficient to cause said brazing matrix to reach at least a semi-solid state.

19. The method according to claim 13, wherein said heating step includes heating said backing surface sufficiently to obtain a hardness of approximately 70 HRB.

20. The method according to claim 13, wherein said granular particle coating includes a refractory metal from the group consisting of the carbides of silicon, tungsten, molybdenum, chromium, tantalum, niobium, vanadium, titanium, zirconium, and boron.

21. A method for producing a die insert for engaging tubular members comprising the steps of:

a. providing a metal die body shaped to be inserted into a tubular gripping system, said die body including a gripping surface having a series of raised teeth;

b. applying a granular particle coating and a brazing matrix to a portion of said raised teeth which engage a tubular member;

c. heating said raised teeth sufficiently to melt said brazing matrix; and d. subjecting said die to a quench and temper process after said heating step.

22. A method according to claim 21, wherein said granular particle coating is applied to substantially all of said gripping surface.

23. A method according to claim 21, wherein said granular particle coating is approximately 0.25 mm in thickness.

24. A method according to claim 21, wherein said granular particle coating includes particles having a size range from approximately 145 to approximately 165 microns.

25. A method according to claim 21, further subjecting said die to a carburization and heat treating process prior to applying said granular particle coating.

26. A method according to claim 21, wherein said quench and temper process is conducted to provide said die insert with a hardness of approximately 58 to 62 HRC.

27. A die insert for engaging tubular members produced by the process comprising the steps of:

a. providing a metal die body having a first hardness and an arcuate shape corresponding to the curvature of an oilfield tubular member having a standard diameter, said die body further having a backing surface formed thereon;

b. coating at least a portion of said backing surface a granular particle coating and a brazing matrix;

c. heating said die body until said brazing matrix melts, thereby adhering said granular particles to said backing surface and softening said metal to a second lesser hardness; and d. thereby producing a die with a softened metal body such that said backing surface may engage an oilfield tubular member with sufficient force to embed said granular particles in said backing surface without reducing the standard diameter of the tubular member.

28. A method according to claim 1, wherein said step of providing a gripping system includes providing a coil tubing injector.

29. A method according to claim 1, wherein said step of providing a gripping system includes providing a pipe spinner apparatus.

30. A method for producing a die insert for engaging tubular members comprising the steps of:

a. providing a metal die body having an arcuate shape corresponding to the curvature of an oilfield tubular member having a standard diameter, said die body further having a metal backing surface with a first hardness formed thereon;

b. coating at least a portion of said backing surface with a granular particle coating having a second hardness greater than said first hardness; and c. adhering said granular particle coating to said backing surface such that said backing surface may engage an oilfield tubular member with sufficient force to embed said granular particles in said backing surface without reducing the standard diameter of the tubular member.

31. The method according to claim 30, wherein said step of adhering said granular particle coating to said backing surface is accomplished using a low temperature curing adhesive.

32. The method according to claim 30, wherein said step of adhering said granular particle coating to said backing surface is accomplished using a brazing matrix with a melting point less than approximately a transformation starting temperature for said metal backing surface.

33. The method according to claim 30, wherein said step of adhering said granular particle coating to said backing surface is accomplished using a thermal spray process wherein a molten metallic brazing matrix mixed with granular particles is sprayed onto said backing surface in a manner which does not raise the temperature of said backing surface above a transformation temperature for said metal backing surface.

* * * * *